US008316467B2

(12) United States Patent
Foust et al.

(10) Patent No.: US 8,316,467 B2
(45) Date of Patent: Nov. 27, 2012

(54) HEADGEAR WITH POCKETS FOR CARRYING AN AUDIO DEVICE AND A METHOD FOR USING THE SAME

(75) Inventors: Karl Foust, Delray Beach, FL (US); Fabrizio Cabianca, Lake Worth, FL (US)

(73) Assignee: Todd Buchanan, Bristol, VA (US)

( * ) Notice: Subject to any disclaimer, the term of this patent is extended or adjusted under 35 U.S.C. 154(b) by 776 days.

(21) Appl. No.: 11/711,797

(22) Filed: Feb. 27, 2007

(65) Prior Publication Data

US 2007/0226876 A1 Oct. 4, 2007

Related U.S. Application Data

(60) Provisional application No. 60/777,766, filed on Mar. 1, 2006.

(51) Int. Cl.

| | |
|---|---|
| ***A42B 1/24*** | (2006.01) |
| ***A42B 1/00*** | (2006.01) |
| ***H04B 1/08*** | (2006.01) |
| ***H04M 1/00*** | (2006.01) |

(52) U.S. Cl. ..... 2/209.13; 2/195.1; 455/351; 455/575.5

(58) Field of Classification Search ..... 2/410, 6.2, 2/422, 10, 171, 209.12, 209.13, 209.14; 455/351; 381/301

See application file for complete search history.

(56) References Cited

U.S. PATENT DOCUMENTS

| | | | | |
|---|---|---|---|---|
| 5,034,995 | A * | 7/1991 | Ciccone | 455/344 |
| 5,303,426 | A * | 4/1994 | Jones | 2/181 |
| 5,329,592 | A * | 7/1994 | Altman | 381/379 |
| 5,438,698 | A * | 8/1995 | Burton et al. | 455/351 |
| 5,881,390 | A * | 3/1999 | Young | 2/209.13 |
| 5,996,124 | A | 12/1999 | Asp, Jr. | |
| 7,044,615 | B2 | 5/2006 | Gesten | |
| 2004/0204207 | A1 * | 10/2004 | Parker | 455/575.2 |
| 2004/0244096 | A1 * | 12/2004 | Claro | 2/195.2 |
| 2005/0123151 | A1 * | 6/2005 | Whipple | 381/103 |
| 2006/0185062 | A1 | 8/2006 | Peng et al. | |
| 2006/0251283 | A1 * | 11/2006 | Yeh | 381/388 |
| 2008/0044052 | A1 * | 2/2008 | Whipple | 381/376 |

FOREIGN PATENT DOCUMENTS

| | | | |
|---|---|---|---|
| KR | 2003060041 A | * | 7/2003 |
| KR | 2005083269 A | * | 8/2005 |

* cited by examiner

*Primary Examiner* — Shelley Self
*Assistant Examiner* — Jane Yoon
(74) *Attorney, Agent, or Firm* — Laurence A. Greenberg; Werner A. Stemer; Ralph E. Locher

(57) ABSTRACT

A cap, hat or other head covering, with pockets for carrying an MP3 player or other portable audio device and the wires and other related accessories. One of the pockets is structured to secure an audio device and the other pocket is structured to secure the headphone wires therein. By disposing the pockets on the headgear, the audio device is in close proximity to the wearer's head, thereby minimizing the length of wire extended between the audio device and the headphones or earplugs and allowing the wearer to perform a desired activity without the wires getting in the way.

15 Claims, 10 Drawing Sheets

310
320
330
330a
330b
360
370
380
386
390

FIG. 9A
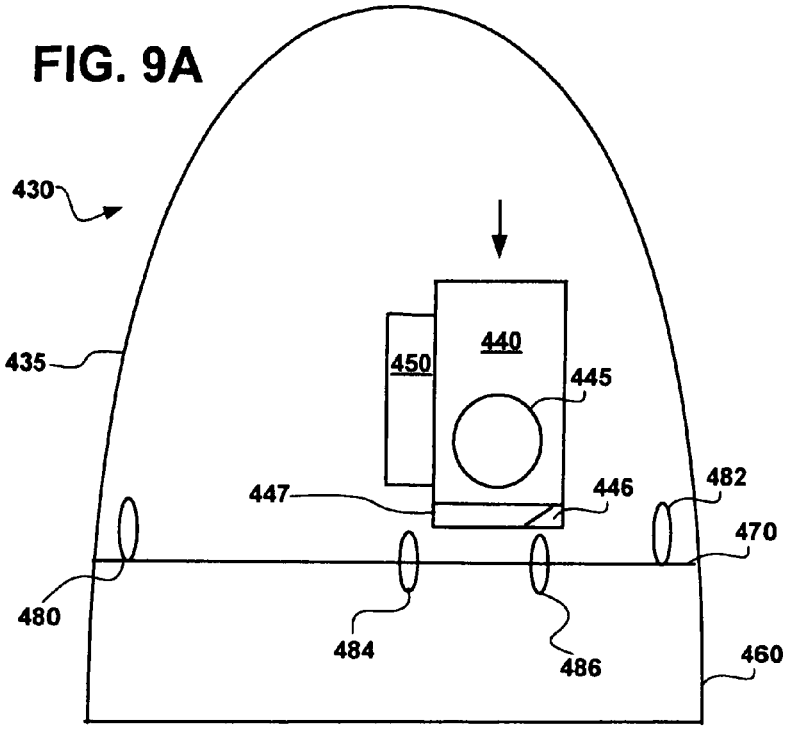
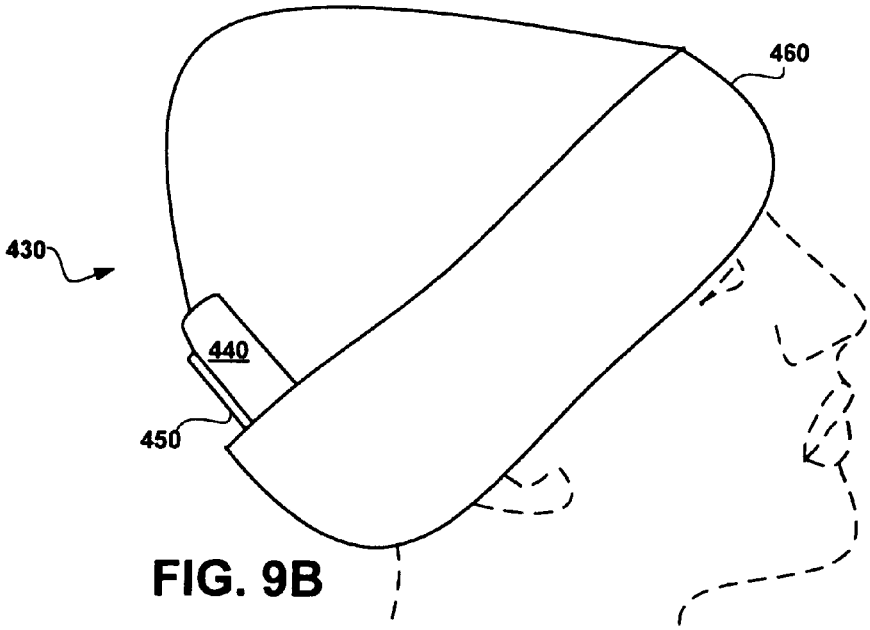
FIG. 9B

HEADGEAR WITH POCKETS FOR CARRYING AN AUDIO DEVICE AND A METHOD FOR USING THE SAME

CROSS-REFERENCE TO RELATED APPLICATION

The present application claims priority from provisional patent application Ser. No. 60/777,766, filed on Mar. 1, 2006, entitled CAP WITH POCKETS FOR CARRYING AN AUDIO DEVICE.

BACKGROUND OF THE INVENTION

1. Field of the Invention

The present invention relates generally to headgear and, more particularly, to a hat, cap, headband, bandana or other type of head covering with pockets for carrying an audio device, headphone and earplug wires and other related accessories, and a method for using the same.

2. Description of the Related Art

The use of MP3 players and other portable audio devices continues to increase significantly each year as the size and weight of the devices continue to shrink. A common problem associated with these devices when being used while participating in sports or involved in any other activity is how to carry them. Many runners, walkers, bikers and the like simply carry the devices in their hands. Others carry the devices in their shirt or pant pockets, carrying bag or in a fanny pack.

However, each of these means of carrying the audio device results in wires extending a significant distance between the audio device and the headphones or earplugs. When running, biking, walking, participating in other sporting activities or performing any other activity, the wires extending up a persons body to his or her head are a nuisance that often hinders the person's ability to efficiently perform the activity and detracts from the overall atmosphere for which the music was intended.

Accordingly, there is still a need in the art for an improved means of carrying MP3 players and other audio devices. Any such device should allow for hands-free operation of the audio device and should be disposed in close proximity to the wearer's head to minimize the distance to the headphones or earplugs and allow the wearer to perform the desired activity without any hindrance from the audio device and/or its wires.

The present invention is particularly suited to overcome those problems that remain in the art in a manner not previously known.

SUMMARY OF THE INVENTION

The present invention is directed towards headgear, including hats, caps and other head coverings with pockets for carrying an MP3 player or other portable audio device (hereinafter referred to as "audio device") and the wires and other related accessories. One of the pockets is structured to secure an audio device and the other pocket is structured to secure the headphone wires therein. By disposing the pockets on the headgear, the audio device is in close proximity to the wearer's head, thereby minimizing the length of wire extended between the audio device and the headphones or earplugs and allowing the wearer to perform a desired activity without the wires getting in the way.

Other features which are considered as characteristic for the invention are set forth in the appended claims.

Although the invention is illustrated and described herein as embodied in a cap with pockets for carrying an audio device, it is nevertheless not intended to be limited to the details shown, since various modifications and structural changes may be made therein without departing from the spirit of the invention and within the scope and range of equivalents of the claims.

The construction of the invention, however, together with additional objects and advantages thereof will be best understood from the following description of the specific embodiment when read in connection with the accompanying drawings.

BRIEF DESCRIPTION OF THE DRAWINGS

For a fuller understanding of the nature of the present invention, reference should be had to the following detailed description, taken in connection with the accompanying drawings in which:

FIG. 9A is a rear view of another cap in accordance with one particular embodiment of the instant invention.

FIG. 9B is a side perspective view showing the cap of FIG. 6A, as worn.

Like reference numerals refer to like parts throughout the several views of the drawings.

DETAILED DESCRIPTION OF THE PREFERRED EMBODIMENT

Figure 1B:
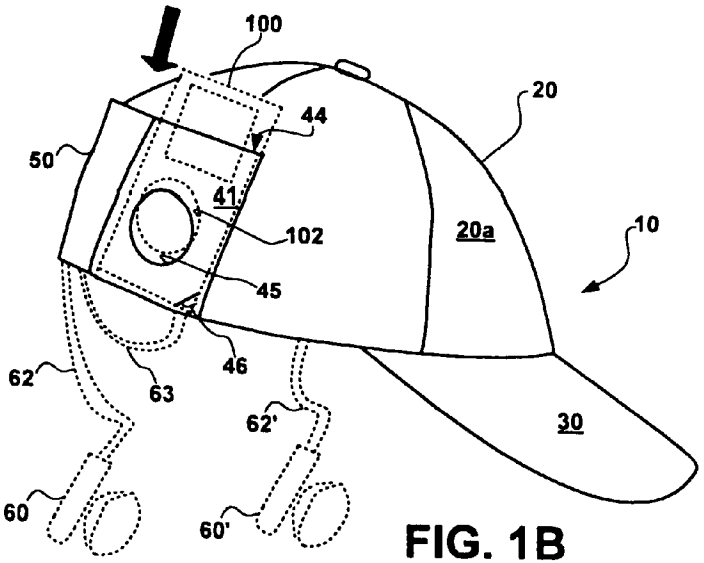
FIG. 1B is a side perspective view of the cap of FIG. 1A.

The present invention is directed towards new and improved headgear for carrying a portable audio device and the wires and other related accessories. It is envisioned that many types of headgear, including hats, caps, headbands, bandanas and other head coverings, can be adapted for use in connection with the present invention. Referring now to FIGS. 1A-1C and 2A-2C, there is shown one particular embodiment of a cap 10 having a dome-shaped head covering or head-engaging portion 20 and a visor 30 extending outward from the head covering portion 20. The cap 10 is, for example, of the type referred to as a baseball cap. The head covering/engaging portion 20 includes an outer surface 20*a* and an inner surface 20*b* (shown more particularly in FIG. 2A) located adjacent to the wearer's head when worn. The head covering portion 20 may also include an adjustment band 22 located at the bottom rear of the cap 10 (i.e., opposite the visor 30) to vary the size of the cap to accommodate different wearer's having different head sizes. The adjustment band 22 includes two mating portions 22*a*, 22*b*, which mate, typically, using a hook and loop type fastener.

Additionally, in accordance with the present invention, the cap 10 includes an audio device pocket/holder 40 and a wire pocket 50, attached to the outer surface 20*a* of the head covering portion 20. Note however, if desired, either or both of the audio device holder/pocket 40 and/or the wire pocket 50 can be attached to the inner surface 20*b* of the head covering/engaging portion 20 of the headgear 10.

One of the pockets 40 is structured to secure an audio device (shown as the audio device 100, in shadow, in FIG. 1B) therein and the other pocket 50 is structured to secure the headphone wires (additionally shown in shadow in FIG. 1B), therein.

Although the shape of the pocket 40 can be sized and/or adapted to any particular audio device to be located therein, in the present embodiment, the audio device pocket 40 is generally rectangular shaped and includes an outer portion 41 secured to the outer surface 20*a* of the head covering portion 20 along the bottom edge 42 and side edges 43, 43' of the pocket 40. In the particular embodiment, the top edge 44 of the pocket 40 is open, so that an audio device can be inserted (i.e., in the direction of the arrow of FIG. 1B) and removed. Although not shown in connection with the present preferred embodiment, if desired, the audio device pocket 40 may include a closeable flap to allow the wearer to cover or close the open top edge 44 to further secure the audio device therein. Additionally, although, in the present embodiment, the audio device is shown as being "top-loaded", the pocket 40 can be connected to the head-engaging portion 20, so that the audio device can be "side-loaded", as will be explained more particularly in connection with another embodiment of the present invention. For example, if desired, the top edge 44 may be closely attached to the head covering 20, while the edge 43' may be left open for insertion ad removal of the audio device. Further, as shown in FIG. 1B, a portion of the audio device 100 can extend beyond the top edge 44 of the pocket 40. Alternately, if desired the NANO, or even a smaller device, such as the IPOD SHUFFLE by APPLE, Inc., could be totally encompassed within a pocket 40, while its selection buttons/wheel are accessible through a cutout or window 45.

The outer portion 41 of the audio device pocket 40 may include one or more cutout or window portions 45 to enable the wearer to access the audio device controls (shown as the control wheel 102, in shadow, in FIG. 1B) without removing the audio device from the pocket 40. Such portions 45 may be open or may be covered with a thin sheet of transparent material (such as clear plastic) in order to protect the controls of the audio device. In one particular preferred embodiment, the audio device pocket 40 is structured to accommodate an IPOD NANO MP3 player by APPLE, Inc., and a pair of cutout portions 45, 46 are provided. A generally circular-shaped window portion 45 is disposed approximately in the center of the outer portion 41 of the audio device pocket 40 to allow access to the device controls. The pocket 40 can include a further cutout portion 46 disposed towards the bottom of the outer portion 41 of the audio device pocket 40 to allow the headphone wire to extend therethrough for attachment to the audio device. It should be appreciated that the number of cutout portions and the configuration and location of the cutout portions may vary to correspond with other types of audio devices.

In the present preferred embodiment, the audio device pocket 40 is constructed of a material and fabric similar to the material and fabric used in the head engaging/covering portion 20, so as to create a uniform appearance. However, it should be appreciated that any other material may be used.

Figure 1A:
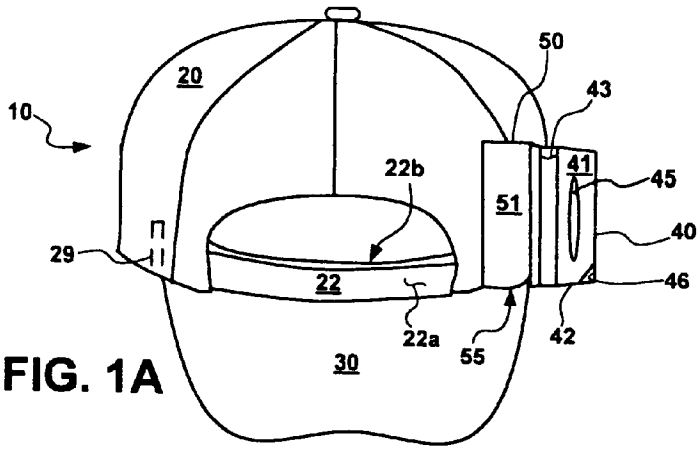
FIG. 1A is a rear perspective view of a cap with pockets for carrying devices in accordance with one particular embodiment of the present invention.
Figure 1C:
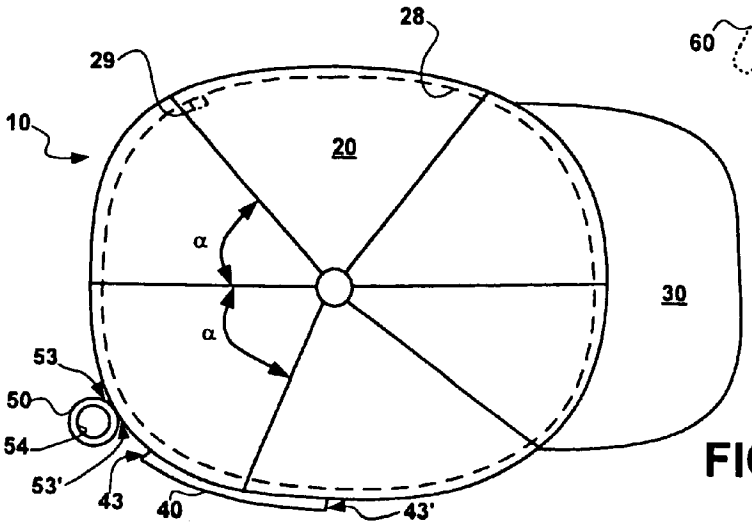
FIG. 1C is a perspective view, taken from the top, of the cap of FIG. 1A.

Additionally, referring more particularly, to FIGS. 1A-1C, the wire containing pocket or wire pocket 50 is generally tubular in shape and includes an outer portion 51 secured to the outer surface 20*a* of the head covering portion 20 along its side edges 53, 53'. In the instant embodiment, the wire pocket 50 is open at both the top edge 54 and the bottom edge 55. However, it should be understood that the top edge 54 could additionally be closed, if desired. Further, although the wire pocket 50 can be made using any material, as desired, in the present preferred embodiment, the outer portion 51 of the wire pocket 50 is constructed of an elastic material capable of securing bundled headphone wires within the wire pocket 50. Please note that, the word "pocket" is used herein to refer to "loop-like" wire holders (i.e., open on two sides and/or edges), "flap-type" wire holders (as described in connection with FIGS. 8A-8C) and "pouch-type" wire holders (i.e., open on only one side or edge).

In the present preferred embodiment, the audio device pocket 40 and the wire pocket 50 are located side by side, towards the back of the head covering portion 20. However, it should be appreciated that the pockets may be positioned together (proximal or adjacent to one another) or separately (distal from one another) anywhere else on the head covering portion 20 or visor 30, and still be within the scope of the present invention.

Additionally, referring back to FIGS. 1A and 2A-2C, the cap 10 can include an inner headband or liner 28. In the present preferred embodiment, inside the cap 10, there is provided a loop 29, adjacent to the inner liner 28. The loop 29 can be made of any material, as desired, but preferably is made from an elastic material, as will be described more fully herebelow. Additionally, the loop 29 is located about 90 degrees-110 degrees around the circumference of the cap from the pocket 40 (i.e., $\alpha$=45 degrees in FIG. 1C).

In use, an audio device (100 of FIG. 1B) is inserted into the audio device pocket 40 and a portion 63 of the headphone or earplug wire, which terminates in an electrical connector (105 of FIG. 5A), is run from the pocket 50 to the pocket 40, wherein the headphone wire connector is inserted through the bottom cutout portion 46 of the pocket 40 and plugged into the mating electrical connector of the audio device. The excess portion of the headphone or earplug wires 62, 62' 63 are bundled and inserted through the open bottom edge 55 of the wire pocket 50, leaving enough wire on the headphone or earplug end outside the pocket 50, to comfortably extend between the bottom edge 55 of the wire pocket 50 and the ears of the wearer. As will be described more particularly herebelow, headphone and/or ear piece wires can be bundled with or without a wire guide, such as a spool, prior to placement into the wire pocket 50.

By arranging the pockets 40, 50 and the loop 29 on the cap 10, as shown in FIG. 1C, each of the earplugs 60, 60' can be disposed and maintained in close proximity to one of the wearer's ears, thereby minimizing the length of wire extended between the audio device and the headphones or earplugs 60, 60'. This gathering and shortening of the wires 62, 62', 63, permits the wires, to extend between the audio device and each ear piece 60, 60' located in one of the wearer's ears, without the wires getting in the way of and/or interfering with activities performed by the wearer.

Figure 4A:
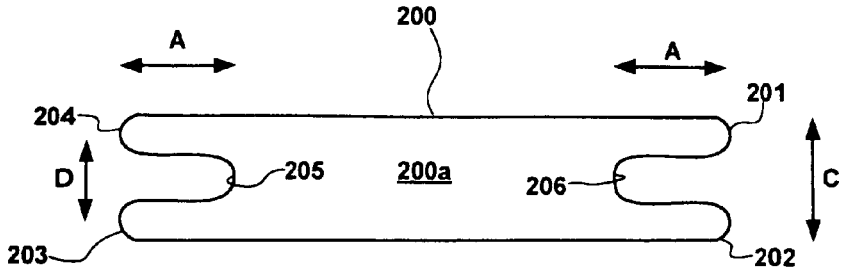
FIG. 4A is an enlarged side plan view of a flat wire spool, in accordance with one particular embodiment of the present invention.
Figure 4B:
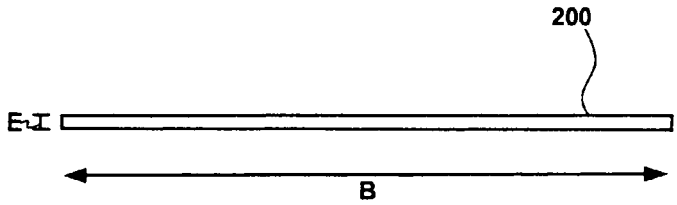
FIG. 4B is an enlarged top plan view of the flat wire spool of FIG. 4A.
Figure 4C:
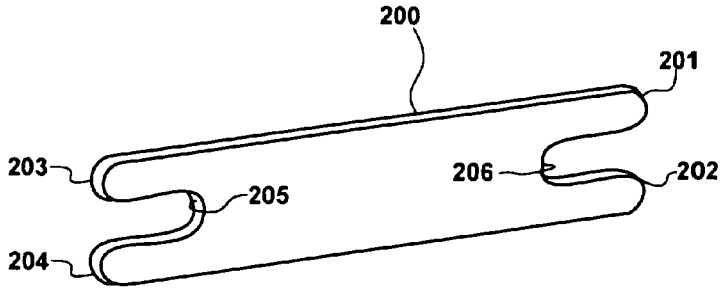
FIG. 4C is an enlarged perspective view of the flat wire spool of FIG. 4A.
Figure 5A:
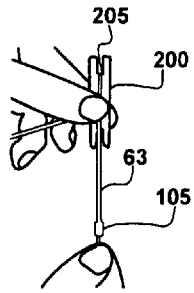
FIG. 5A is a partial perspective view of a wire being wound around a spool in accordance with one particular embodiment of the present invention.

Additionally, in one particularly preferred embodiment, the excess wire is maintained in an orderly fashion in the pocket 50, using a spool, such as the flat wire spool or spool 200 of FIGS. 4A-4C. The spool 200 is relatively flat and generally "H" shaped. More particularly, a body portion 200*a* includes the legs 201, 202, 203, 204 and valleys 205, 206. In the instant example, legs 201 and 202 are disposed at a first end of the body 200*a*, and are separated by the valley 206, while legs 203 and 204 are disposed at the opposite end of the body 200*a*, and are separated by the valley 205. In use, in the present preferred embodiment, it is desirable for the excess headphone and/or earplug wire to be wrapped around the flat wire spool 200 (i.e., from valley to valley, as shown in FIG. 5A). However, in a lesser preferred embodiment, the wire spool may be differently shaped, differently wrapped or omitted entirely. For example, in an embodiment omitting a spool, the excess wire gathered (i.e., "bunched") for placement in the wire pocket 50 of the cap 10, as described above in connection with FIGS. 1A-1C.

In one particular embodiment of the instant invention, the length A of each leg 201, 202, 203, 204 of the flat wire-spool 200 is about 0.425", while the spool 200 has an overall length B of about 2.250". Additionally, in the present particular embodiment, the width C of the spool 200 is about 0.460", while the peak-to-peak distance D between the legs 201, 202, as well as between the legs 203, 204 (i.e., forming the valleys or notches 205, 206) is about 0.167". Further, in the present embodiment, the thickness E of the spool 200 is 0.050". Note that, it can be seen that spools of other dimensions can be used in connection with the instant invention, without deviating from the spirit of the instant invention.

Figure 2A:
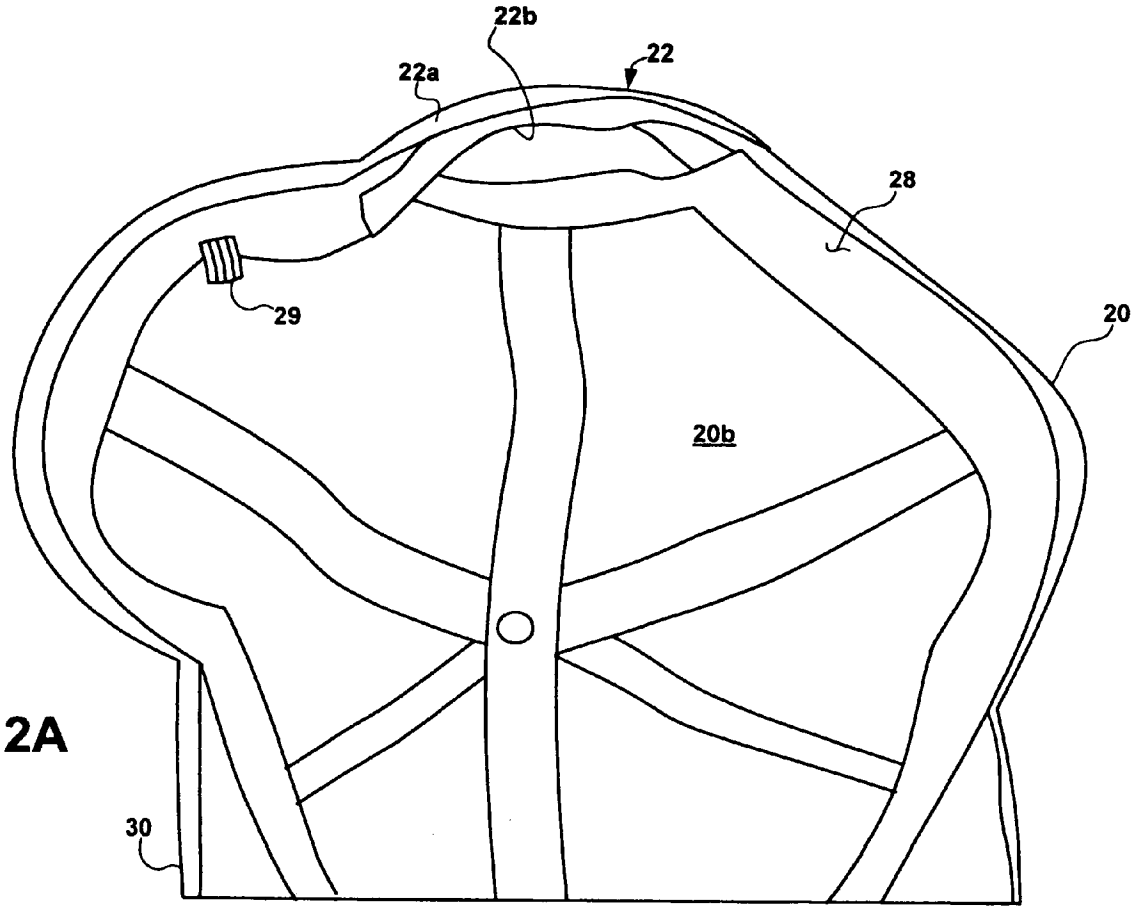
FIG. 2A is a partial perspective view, taken from the bottom (showing the inside) of a cap in accordance with one particular embodiment of the present invention.
Figure 2B:
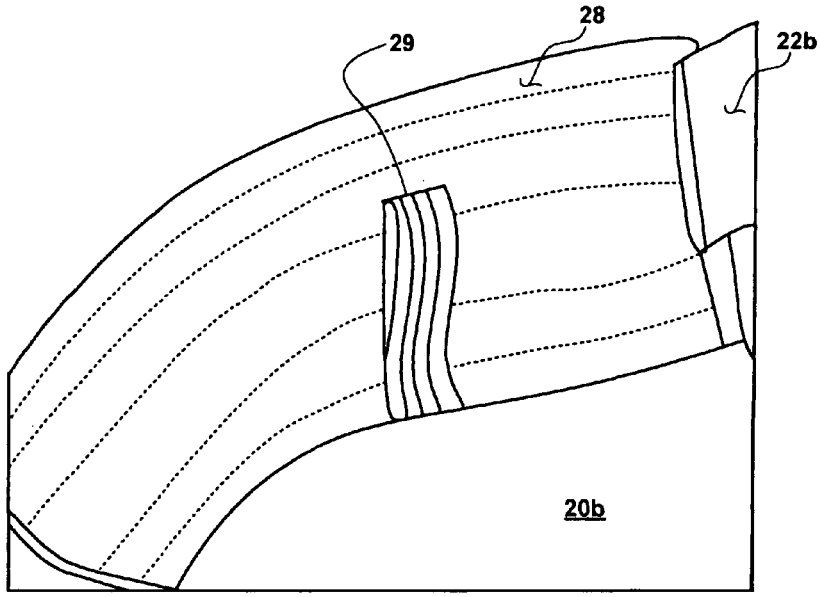
FIG. 2B is an enlarged view of a portion of the cap shown in FIG. 2A.
Figure 2C:
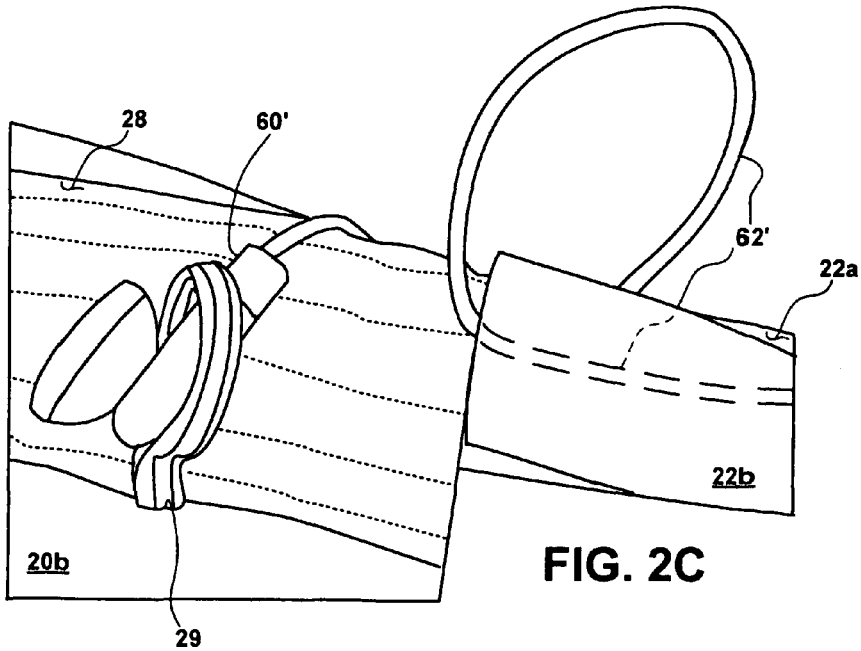
FIG. 2C is an enlarged view of a portion of the cap shown in FIG. 2A engaged with an earpiece, in accordance with one particular embodiment of the present invention.
Figure 3:
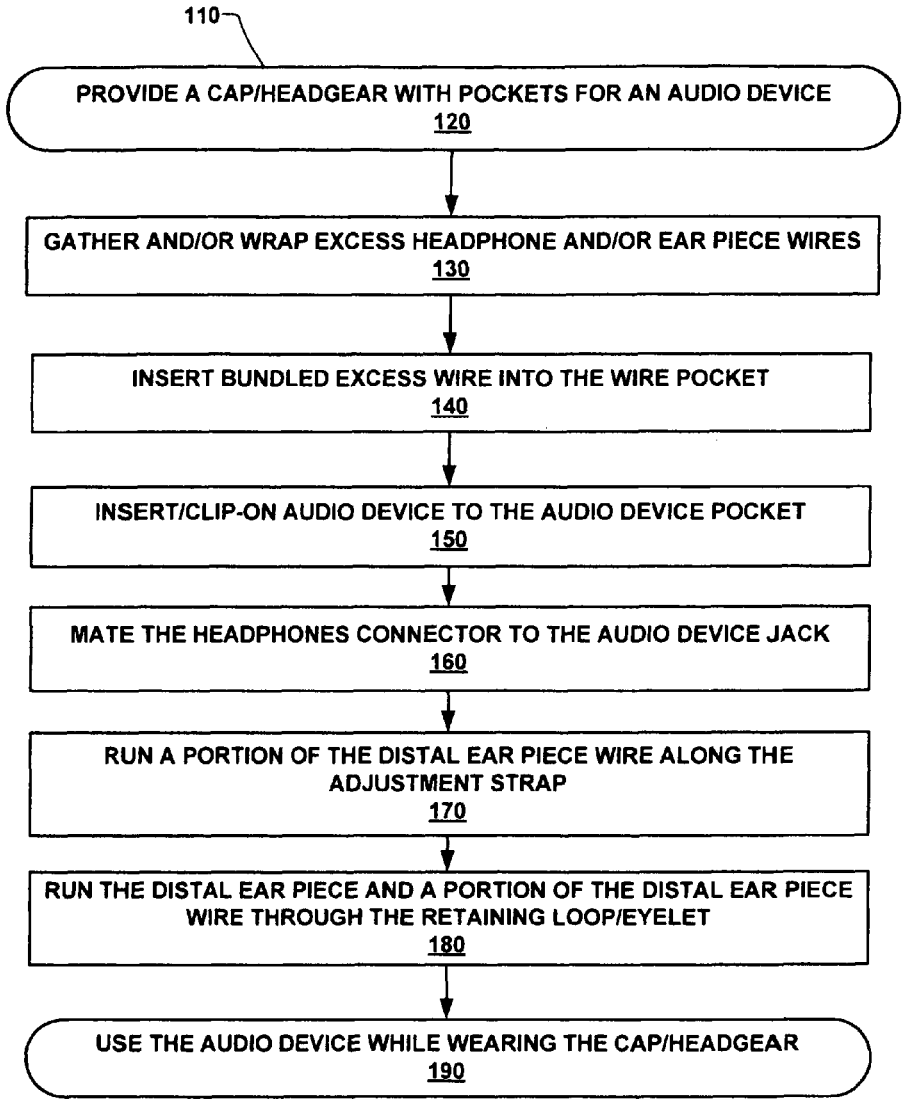
FIG. 3 is a flow diagram illustrating one particular embodiment of a method for using the headgear of the present invention.

Referring now to FIGS. 1-5, and particularly, to FIG. 3, there will be described a method 110 of arranging and using a cap, hat visor or other head gear, such as cap 10, in accordance with one particular invention. More particularly, headgear including both an audio device pocket 40 and a wire pocket 50 are provided. Step 120. The excess headphone and/or ear piece wire is then, in the present embodiment, wrapped around a spool, such as the flat wire spool 200 of FIGS. 4A-4C. As indicated elsewhere herein, if desired, the spool may be omitted and the excess wire can be gathered and deposited directly in the wire pocket 50. Step 130. However, if a spool is used, the user will hold the spool with one hand and the headset connector 105 with the other hand, as shown more particularly in FIG. 5A. In one particular embodiment, the connector is held so as to maintain about 1.5-2.0 inches of free cord, depending upon the audio device used and the distance of the audio connector from the wire pocket. Holding the spool 200 and wire connector 105, as described in connection with FIG. 5A, the excess wire is wrapped around the spool 200, starting at the top valley or notch 205. In one particularly preferred embodiment, the excess wire is wrapped around the spool 200 until a portion of cord hanging from the spool is about 9.5 inches in length (excluding the length of the ear pieces). Note that, in the instant embodiment, both the left and right earpieces should be at the same distance with respect to the spool. At this point, in the present embodiment, winding of the wire to the left ear piece is stopped, while winding of the wire to the right ear piece (i.e., or the ear piece to the ear closest to the wire pocket 50) continues until the hanging part of that wire is approximately 4.5 inches in length.

Figure 5B:
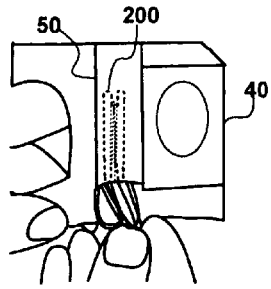
FIG. 5B is a partial perspective view of a wire wrapped spool being inserted into a wire pocket in accordance with one particular embodiment of the present invention.

Once wrapped onto the spool or gathered, in the manner described above, the wire bundle (and spool, if used) is pushed into the wire pocket 50, as shown in FIG. 5B. As stated above, in one particular preferred embodiment of the present invention, the wire pocket 50 is elastic, thus it is able to secure the spool and wire bundle in a frictional embrace. Step 140. In order to assist in placing the spool and wire bundle into an elastic wire pocket, the fabric of the pocket 50 can be stretched by inserting a finger into the top opening 54 of the elastic wire pocket 50.

After the spool and/or wire bundle are inserted into the wire pocket 50, the audio device 100 is inserted into the audio device pocket 40. Step 150. Note that the electrical connector/headset jack of the audio device 100 will need to point downwards, in alignment with the opening 46 at the bottom of the pocket 40. If the device is a clip-on device, instead of being inserted into the pocket, or in addition to being inserted into the pocket, the device is clipped to the pocket 40 (or a loop replacing the pocket 40), in step 150.

Once located in the pocket, the headset connector 105 is mated with an electrical connector (not shown) on the audio device 100, through the opening 46. Step 160.

Additionally, in order to prevent the wire to the left ear piece (i.e., or the ear piece distant most from the pocket 50) from draping and/or becoming entangled, the wire to the distal ear piece can be entrapped in a portion of the cap 10. For example, one portion of the wire to the distal ear piece can be entrapped in the adjustment strap 22 of the cap 10. Step 170. For example, with the adjustment strap 22 open, a portion of the wire 62' can be located along the center of the bottom strap portion 22*b*. Mating the strap portion 22*a* over the strap portion 22*b*, and the portion of the wire 62' passing therethrough permits a portion of the wire 62' to the distal ear piece 60' to be "sandwiched" between the two hook and loop fastener portions of the adjustment strap 22. If the headgear in use does not include an adjustment strap, step 170 can be omitted.

Additionally, the distal ear piece 60' and a further portion of the wire 62' to the distal ear piece 60' are passed through the loop 29 (or an eyelet, as described in connection with FIG. 9, herebelow) on the inside 20*b* of the cap 10, adjacent the inner liner 28, as shown more particularly in FIG. 2C. Step 180. Releasing the distal ear piece 60' will permit it to dangle in close proximity to the left ear, as shown more particularly, in FIG. 5C.

Figure 5C:
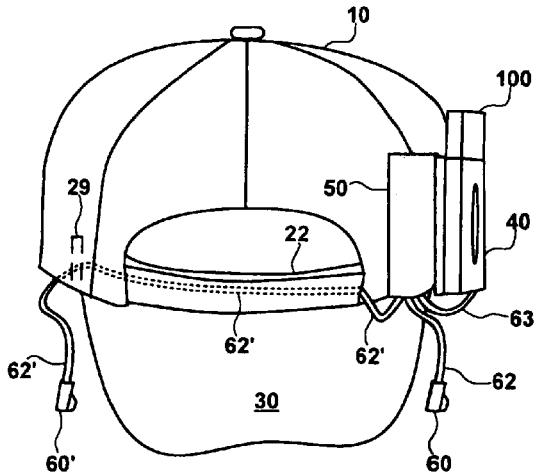
FIG. 5C is a rear view of a cap having an audio device and headphones engaged with the cap, in accordance with one particular embodiment of the present invention.

Once the two ear pieces are dangling from the cap, as shown in FIG. 5C (i.e., separated by about 90 degrees-110 degrees circumferentially around the back of the cap), the cap 10 can be worn and the audio device used. Step 190.

Figure 6B:
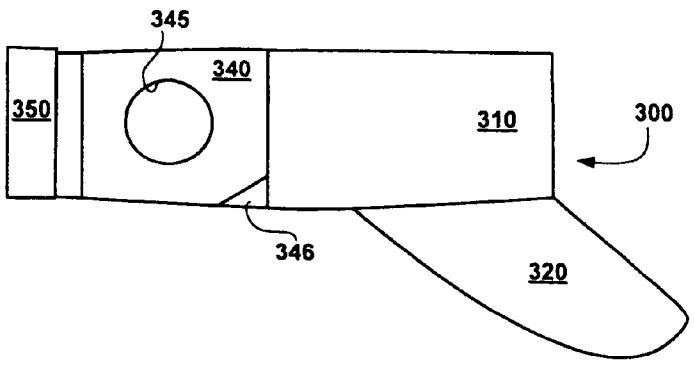
FIG. 6B is a side perspective view of the visor of FIG. 6A.
Figure 6A:
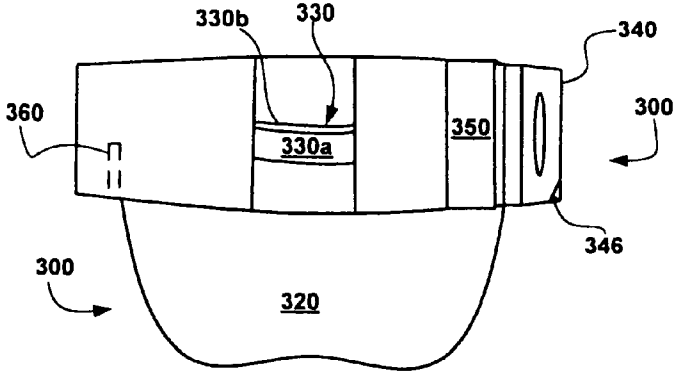
FIG. 6A is a rear perspective view of a visor with pockets for carrying devices in accordance with one particular embodiment of the present invention.
Figure 6C:
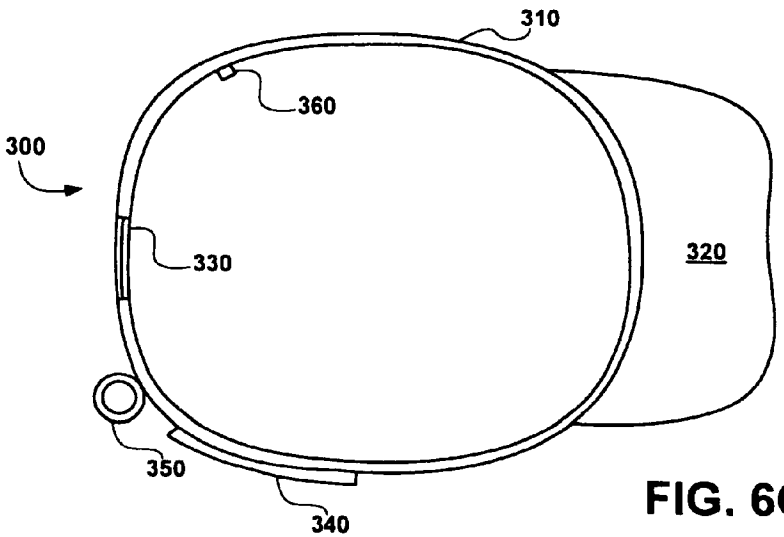
FIG. 6C is a perspective view, taken from the top, of the visor of FIG. 6A.

Referring now to FIGS. 6A-6C, there is shown another type of headgear adapted for use with the present invention. More specifically, FIGS. 6A-6C show one particular embodiment of a visor 300, in accordance with the instant invention. The visor 300 includes a head band or head-engaging portion 310 and a visor portion 320. As with the cap 10, described in connection with FIGS. 1A-1C, the visor 300 includes a mating adjustment strap 330, formed of a top portion 330*a* and bottom portion 330*b*, matingly engaged to size the visor to the wearer's head. As with the cap 10, the two portions of the adjustment strap 330*a* and 330*b* are preferably mated using a hook and loop type fastener. However, other mating systems, such as snaps, could be selected.

Additionally, like the cap 10 of FIGS. 1A-1C, the visor 300 includes an audio device pocket 340 and a wire pocket 350. The audio device pocket 340 of the instant embodiment is open at the top to receive an audio device. Additionally, the pocket 340 includes a window portion 345, which can, optionally be covered by a transparent sheet, through which the audio device controls can be accessed. Additionally, an opening 346 is located at the bottom of the pocket 340, in alignment with the head phone jack on the audio device. Note that for different audio devices, the opening 346 will be located in different places, so as to ensure the proper engagement between the connector on the headphones and the headphone jack on the audio device.

Further, as with the cap 10 of FIGS. 1A-1C, in the instant embodiment, the wire pocket 350 of the instant embodiment, is a tubular, elastic pocket that is open at the top and the bottom. Excess headphone and ear piece wire is gathered, preferably on a spool such as the flat wire spool 200, and maintained within the wire pocket 350. The visor 300 additionally includes, on the inner surface thereof, a loop 360 through which the distal ear piece and wire is passed, in order to maintain it in close proximity to the wearer's ear that is located furthest from the pocket 350. The method of FIG. 3 can additionally be used to load and use the visor 300. For example, the distal ear piece wire can be entrapped within the adjustment strap 330 and passed through the loop 360, as described in connection with FIGS. 3 and 5A-5C.

Figures 7A, 7B, 7C:
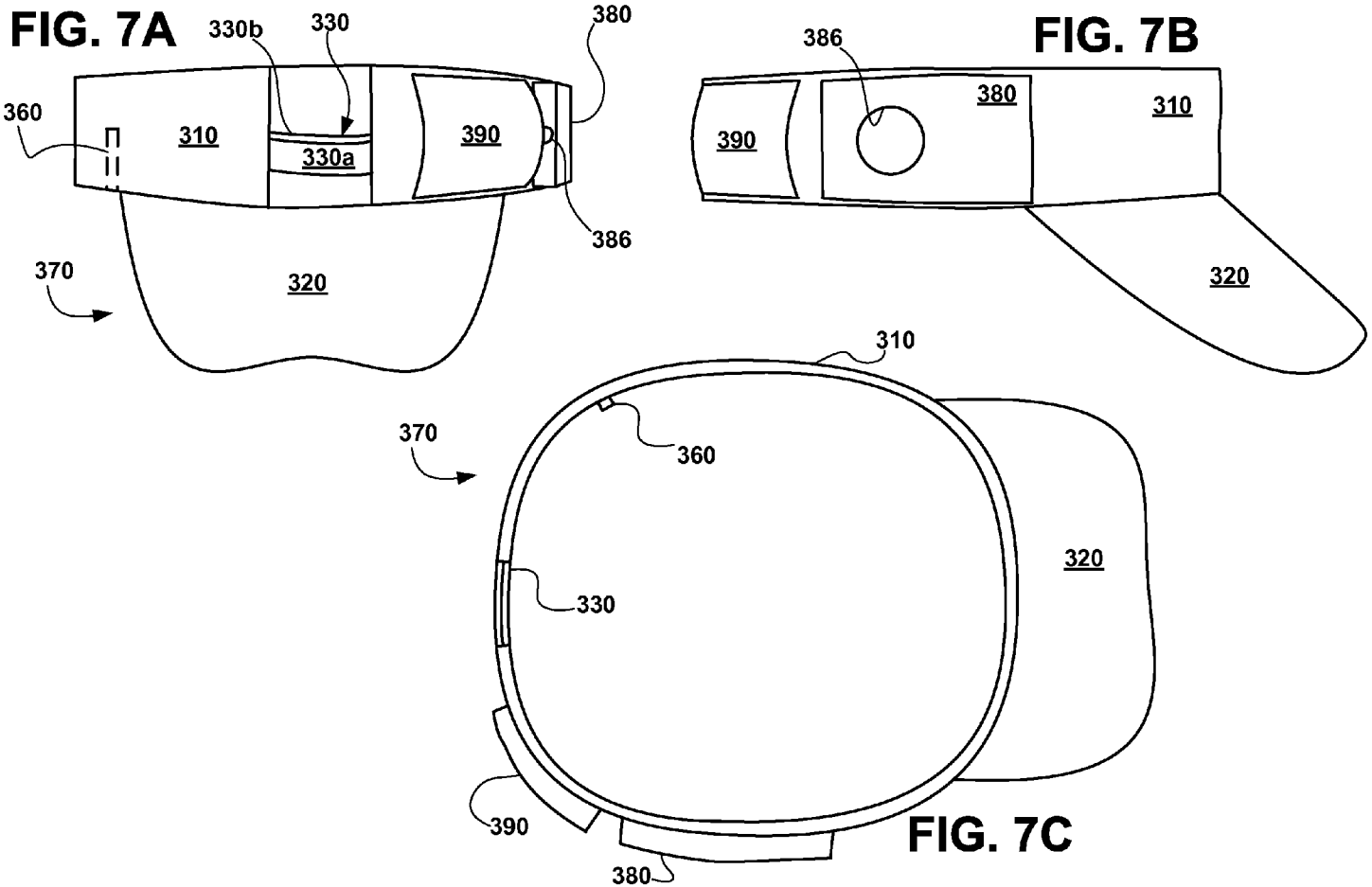
FIG. 7A is a rear perspective view of a visor with pockets for carrying devices in accordance with another particular embodiment of the present invention.
FIG. 7B is a side perspective view of the visor of FIG. 7A.
FIG. 7C is a perspective view, taken from the top, of the visor of FIG. 7A.

Referring now to FIGS. 7A-7C there is shown another embodiment of a visor 370 that can be made in accordance with the instant invention. The visor is similar in most respects to the visor 300 of FIGS. 6A-6C, including a head band or head-engaging portion 310, a visor portion 320, an adjustment strap portion 330 and a loop 360. However, the audio device pocket 380 and wire pocket 390 are differently configured from those described in connection with the previous embodiments. For example, the audio device pocket 380 is slightly larger than the audio pocket 340 of FIGS. 7A-7C, so as to encompass and maintain a larger portion of the audio device therein. Further, instead of being open at the top, the audio device pocket 380 is open at the side furthest from the wire pocket 390 (i.e., in the direction of the visor portion 320), so as to receive an audio device from the side, in the direction of the arrows of FIGS. 7B and 7C. The other side of the pocket (i.e., the side closest to the wire pocket 390) includes a smaller opening 386, for receiving the headphone electrical connector therethrough. Additionally, instead of being tubular, the wire pocket 390 is a side loading pouch type pocket, open at only one edge, into which the gathered excess headphone and/or ear piece wire is placed (i.e., whether wound on a spool or not on a spool). Note that, if desired a closeable flap could be included over the free edge of the wire pocket 390, to further secure the wires and/or spool therein.

Once the excess wire is placed in the wire pocket 390, the proximal ear piece (i.e., the ear piece to the ear nearest the wire pocket) will dangle out from the side opening of the wire pocket 390, while the distal ear piece will dangle about 90 degrees-110 degrees away, from and below the loop 360. The method of FIG. 3 can additionally be used to load and use the visor 370. For example, the distal ear piece wire can be entrapped within the adjustment strap 330 and passed through the loop 360, as described in connection with FIGS. 3 and 5A-5C.

Figure 8B:
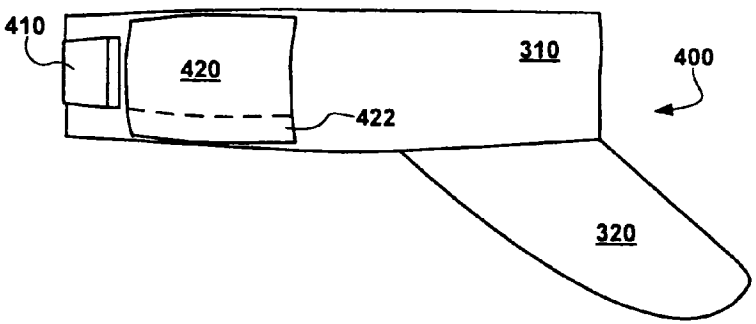
FIG. 8B is a side perspective view of the visor of FIG. 8A.
Figure 8C:
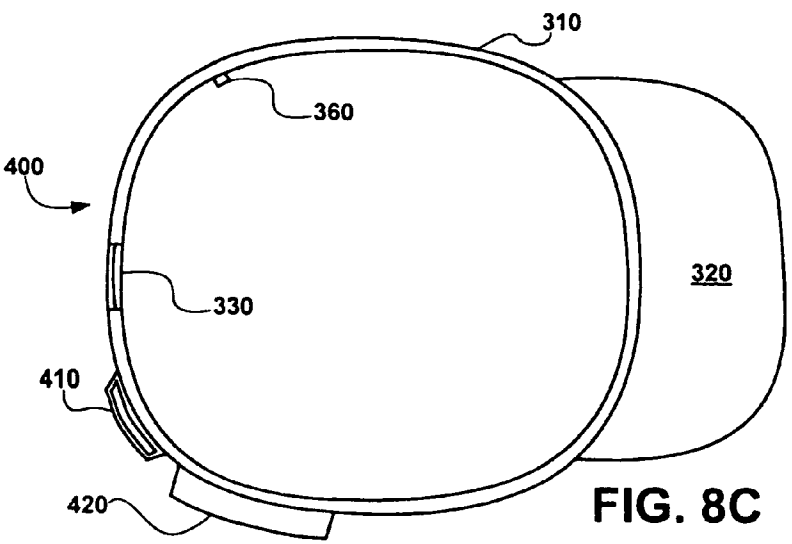
FIG. 8C is a perspective view, taken from the top, of the visor of FIG. 8A.
Figure 8A:
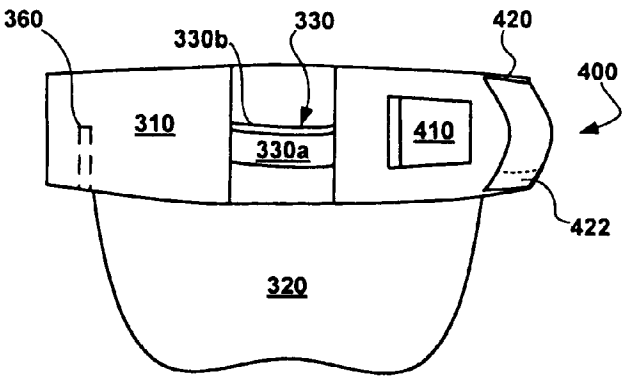
FIG. 8A is a rear perspective view of a visor with pockets for carrying devices in accordance with a further particular embodiment of the present invention.

Referring now to FIGS. 8A-8C there is shown still another embodiment of a visor 400 that can be made in accordance with the instant invention. The visor is similar in most respects to the visor 300 of FIGS. 6A-6C, including a head band or head-engaging portion 310, a visor portion 320, an adjustment strap portion 330 and a loop 360. However, the audio device pocket has been replaced by an audio device loop 410, to which clip-on devices, such as the IPOD SHUFFLE by Apple, Inc., can be clipped. For example, a clip-on audio device can be clipped to the inside and/or the outside of the audio device loop 410. Additionally, in the present embodiment, the audio device loop 410 is open at the top and at the bottom, so that the device can be clipped to the loop 410 from either direction. As such, in the present embodiment, the audio device loop 410 is smaller than the audio pocket 340 of FIGS. 7A-7C, so as to secure a smaller audio device, such as the different versions of the IPOD SHUFFLE by APPLE, Inc. Additionally, a control window can be omitted from the audio device loop 410, as the controls may be accessible from outside the loop 410 (i.e., the portion of the audio device extending outside the pocket 410), or may otherwise not be necessary to access. The headphone electrical connector can be directly engaged with a headphone jack on the device, outside the loop 410.

Further, the wire pocket 420 of the visor 400 is differently configured from those described in connection with the previous embodiments. More particularly, the wire pocket 420 includes a flap which is sewn at the top edge to the head-engaging portion 310, and which secures, at its bottom edge, to the head-engaging portion 310 using complementary hook and loop fastener portions 422 located on the inside of the flap 420 and on the outside of the head-engaging portion 310. Thus, the wire pocket 420 is open at both side edges and, further, is loaded with the wire bundle formed with the gathered excess headphone and/or ear piece wire (including or not including the spool) by lifting the flap 420 from the bottom edge to disengage the hook and loop fastener portions, and re-fastening the hook and loop type fastener portions with the wire bundle located beneath the flap 420. Once the excess wire is placed in the wire pocket 420, the proximal ear piece (i.e., the ear piece to the ear nearest the wire pocket) will dangle from one of the side openings of the wire pocket 420, while the distal ear piece will dangle about 90 degrees-110 degrees away, from and below the loop 360. The method of FIG. 3 can additionally be used to load and use the visor 400. For example, the distal ear piece wire can be entrapped within the adjustment strap 330 and passed through the loop 360, as described in connection with FIGS. 3 and 5A-5C Referring now to FIGS. 9A-9B, there is shown yet another embodiment of headgear in accordance with the instant invention. More particularly, in FIGS. 9A-9B, there is shown a beanie or knit cap 430 including an audio device pocket 440 and a wire pocket 450. The wire pocket 450 is tubular in shape, as with the embodiment of FIGS. 1A-1C and is, preferably, elastic and open at the top and bottom. The wire pocket 450 is connected to the beanie either to the audio device pocket 440, or in close proximity thereto. Additionally, because of the flexibility of the knit cap 430, the audio device pocket 440 is sized to receive and secure substantially the entire audio device. Additionally, the audio device pocket 440 can be loaded from any direction desired. In the embodiment shown in FIGS. 9A-9B, the audio device pocket 440 is bottom loaded (i.e., loaded from the bottom of the pocket at a point adjacent a fold line 470). A flap 447 located at the open edge of the pocket 440 is closed and a hook or loop type fastener portion on the flap is mated with a complementary hook or loop portion on the pocket 440, in order to secure the audio device into the pocket 440. The flap 447 includes a wire receiving opening 446 therethrough, for receiving therethrough a connector from the headphone wires. A control window 445 is provided on the pocket 440, as described elsewhere herein. As with caps of this type, the knit cap 430 is designed to include a cuff portion 460, folded about a fold line 470. The audio device pocket 440 and wire pocket 450 are attached to the head-engaging portion 435 of the knit cap 430, which is above the fold line 470.

Rather than having an adjustment strap or retaining loop, the knit cap is designed to include ear piece openings/eyelets 480, 482, through which the ear pieces are dropped in close proximity to the ears of the wearer. The ear piece openings 480, 482 are located just above the fold line 470, so that the ear piece wire running to the wearer's ears are entrapped in the folded cuff 460 of the knit cap 460. The knit cap 430 can optionally include wire-retaining holes/eyelets 484, 486, located on the fold line 470, through which the wire from the wire pocket 450 connects to the audio device pocket 440, so as to maintain the wire therebetween.

While the invention has been described, disclosed, illustrated and shown in various terms of certain embodiments or modifications, which it has presumed in practice, the scope of the invention is not intended to be, nor should it be deemed to be, limited thereby. For example, although the embodiments shown in the figures show a knit cap, a baseball-type cap and a visor, other types of headgear, such as headbands, bandanas, etc., could be made to include the inventive headgear system of the present invention. Additionally, for example, it should be understood that embodiments showing an audio device containing pocket could, instead, be provided with an audio device loop, and vice-versa. Similarly, any of the types of wire pockets disclosed herein, for example, the wire pockets 40, 390 or 420, can be used in connection with any other embodiment of the invention. Additionally, although the foregoing embodiments show and describe the audio device holder/pocket and the wire pocket on the outside surface of the head gear, it should be understood that, if desired, either or both of the audio device holder/pocket and/or wire pocket can be located adjacent the inside surface of the head-engaging portion of the headgear of the instant invention, without departing from the spirit of the invention. Such other modifications or embodiments as may be suggested by the teachings herein are particularly reserved, especially as they fall within the breadth and scope of the claims here appended.

We claim:

1. A headgear system for holding an audio device having wired headphones, the headgear comprising:

a head-engaging portion having an inside surface and outside surface, said head-engaging portion adapted to engage the head of a user with at least a portion of the inside surface;

an audio device holder located on said head-engaging portion;

a wire pocket fixedly attached to the outside surface of said head-engaging portion for removably receiving at least a portion of the headphone wire, said wire pocket being an elastic, looped tube, secured to the outside surface of said head-engaging portion;

a wire spool for receiving at least a portion of the headphone wires wrapped thereabout; and said wire pocket being sized to removably receive said wire spool and said at least a portion of the headphone wires wrapped thereabout.

2. The headgear system of claim 1, wherein said wire spool is a flat wire spool.

3. The headgear system of claim 1, wherein said wire spool is generally "H" shaped.

4. The headgear system of claim 1, wherein said wire pocket is located on said head-engaging portion adjacent to said audio device holder.

5. The headgear system of claim 1, further including a loop located on said head-engaging portion distal from said audio device holder, said loop sized to receive an earpiece therethrough.

6. The headgear system of claim 1, wherein the wire pocket is open at its top and bottom edges to receive said wire spool through at least one of said openings at its top and bottom edges.

7. The headgear system of claim 1, wherein the audio device holder includes a pocket open at at least one edge.

8. The headgear system of claim 1, wherein the audio device holder is a loop to which the audio device is clipped.

9. A method of attaching an audio device having wired headphones with at least one ear piece to headgear, comprising the steps of:

providing headgear including, a head-engaging portion having an inside surface and outside surface, the head-engaging portion adapted to engage the head of a user with at least a portion of the inside surface, an audio device holder located on the head-engaging portion, and a wire pocket fixedly attached to the outside surface of the head-engaging portion, said wire pocket being an elastic, looped tube, secured to the outside surface of said head-engaging portion;

providing a wire spool;

gathering at least a portion of the headphone wire into a bundle by wrapping at least a portion of the headphone wire around the wire spool;

inserting the bundle including the wire spool into the wire pocket;

securing the audio device to the headgear using the audio device holder; and connecting an electrical connector of the headphone wire to the audio device after the audio device has been secured to the headgear.

10. The method of claim 9, wherein the wire pocket is open at its top and bottom edges and wherein the inserting step includes inserting the bundle including the wire spool through one of the openings in the top and bottom edges.

11. The method of claim 9, further including the steps of:

providing a headgear, in the first providing step, that includes an ear piece wire holder located on the head-engaging portion distal from the audio device holder;

running at least a portion of the ear piece wire along a portion of the head-engaging portion, to the ear piece wire holder; and passing the ear piece through the ear piece wire holder such that the at least one ear piece dangles from the ear piece wire at a position on the head engaging portion, distal from the audio device holder, but adjacent to an ear of the user.

12. The method of claim 11, further including the steps of:

providing a headgear, in the first providing step, that includes a releasably engageable adjustment strap for sizing the head engaging portion to the head of a user;

opening the adjustment strap;

running at least a portion of the wire to the at least one ear piece along a portion of the open adjustment strap; and closing the adjustment strap to entrap a portion of the ear piece wire therein.

13. The method of claim 11, wherein the ear piece wire holder includes a loop secured to the inside surface of the head-engaging portion.

14. The method of claim 11, wherein the ear piece wire holder includes an opening through the head-engaging portion.

15. The method of claim 11, wherein the headphones additionally includes a second earpiece, and the method additionally includes the step of locating the wire pocket adjacent to the other ear of a user and dangling the second ear piece directly below the wire pocket and adjacent to the other ear of the user.

* * * * *